US005393000A

United States Patent [19]

Lagache et al.

[11] Patent Number: 5,393,000

[45] Date of Patent: Feb. 28, 1995

[54] CRUSHER WITH AN ANNULAR ROLLER TRACK

[75] Inventors: Philippe Lagache, Marcq-en-Baroeul; Bernard Boussekey, Lille, both of France

[73] Assignees: Fratelli BUZZI SpA, Casale Monf.to, Italy; FCB S.A., Montreuil, France

[21] Appl. No.: 215,359

[22] Filed: Mar. 21, 1994

[51] Int. Cl.[6] ..... B02C 4/28

[52] U.S. Cl. ..... 241/228; 241/183

[58] Field of Search ..... 241/182, 183, 227, 228

[56] References Cited

U.S. PATENT DOCUMENTS

| | | | |
|---|---|---|---|
| 2,210,357 | 8/1940 | Beament | 241/182 |
| 3,065,920 | 11/1962 | Johnson et al. | 241/182 |
| 4,183,726 | 1/1980 | Seebald | 241/182 |
| 4,211,369 | 7/1980 | Eigner | 241/182 |
| 5,148,997 | 9/1992 | Gotoh et al. | 241/65 |
| 5,205,494 | 4/1993 | Durinck et al. | 241/30 |

*Primary Examiner*—John Husar

*Attorney, Agent, or Firm*—Collard & Roe

[57] ABSTRACT

A crusher comprises a cylindrical body, a lining supported by a portion of the cylindrical body and forming an annular track, the supporting cylindrical body portion having a prismatic interior surface, and at least one roller arranged to roll on the annular track. The lining consists of plates having a concave interior surface shaped to form a rolling surface of the annular track and a flat exterior surface resting on the prismatic interior surface of the supporting cylindrical body portion. This reduces the risk of breakage of the lining plates under the pressure applied thereto by the roller.

11 Claims, 2 Drawing Sheets

CRUSHER WITH AN ANNULAR ROLLER TRACK

BACKGROUND OF THE INVENTION

1. Field of the Invention

The present invention relates to a crusher comprising a cylindrical body comprising an annular track on the interior surface of the cylindrical body and one or more rollers arranged to roll on the annular track. The rollers are pressed against the annular track by weights, by centrifugal force or by such means as jacks or springs to crush any material on the annular track by grinding it between the roller(s) and the track.

2. Description of the Prior Art

A crusher of this type has been disclosed in U.S. Pat. No. 5,205,494, and since the crusher is conventional, only those parts of the crusher relevant to this invention have been illustrated therein.

To avoid too rapid wear of the annular crusher track, it may be lined with hard metal plates. Because of their hardness, it is generally not possible to machine anything but flat faces on these lining plates. The cylindrical surfaces serving to support the plates on the cylindrical crusher body are, therefore, rough as they come from the foundry and their bearing faces are generally not perfect. As a result, the high pressures which the rollers apply to the lining plates during the operation of the crusher may cause them to break. This danger is enhanced by the fact that the plates are generally pierced by holes receiving screws or bolts serving to affix the plates to the cylindrical supporting body and which reduce the mechanical strength of the plates.

SUMMARY OF THE INVENTION

It is the primary object of the invention to eliminate this danger and to assure a perfect bearing of the lining plates on the interior wall of the cylindrical body of the crusher while avoiding the use of any fixing means, such as screws or bolts, for holding the lining plates on the interior surface of the cylindrical body.

The above and other objects are accomplished according to the present invention in a crusher which comprises a cylindrical body, a lining supported by a portion of the cylindrical body and forming an annular track, the supporting cylindrical body portion having a prismatic interior surface, and at least one roller arranged to roll on the annular track. The lining consists of plates having a concave interior surface shaped to form a rolling surface of the annular track and a flat exterior surface resting on the prismatic interior surface of the supporting cylindrical body portion.

The lining plate for an annular track of a crusher comprising a cylindrical body having an interior wall supporting the track and at least one roller arranged to roll on the track, according to this invention has a concave interior surface shaped to form a rolling surface of the annular track and a flat exterior surface adapted to rest on a flat face of the interior wall.

BRIEF DESCRIPTION OF THE DRAWING

The above and other objects, advantages and features of the invention will become more apparent from the following description of certain now preferred embodiments thereof, taken in conjunction with the accompanying drawing wherein.

DETAILED DESCRIPTION OF THE PREFERRED EMBODIMENTS

Figure 1:
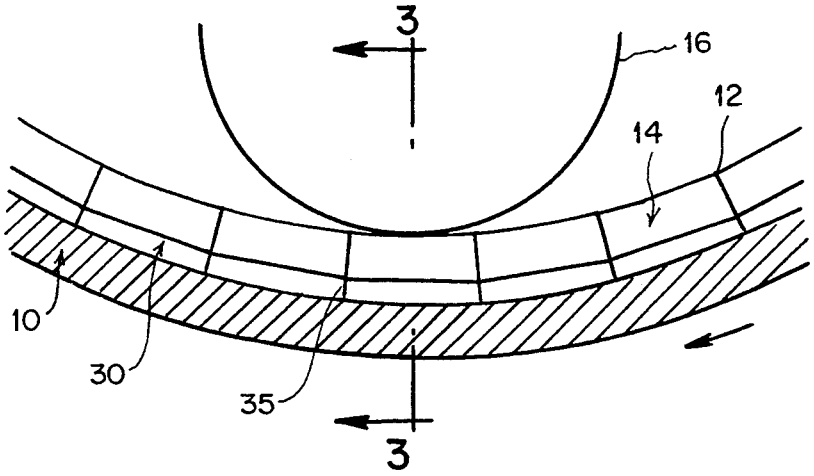
FIG. 1 is a fragmentary view showing in transverse cross section a portion of a cylindrical body of a horizontal crusher, illustrating the annular track according to one embodiment of the present invention and a roller arranged to roll on the track.

Referring now to the drawing wherein like reference numerals in all figures designate like parts, there is shown a portion of a crusher of the type disclosed in U.S. Pat. No. 5,205,494, whose disclosure is incorporated herein by reference. The crusher comprises a rotary body constituted by a short cylindrical body or drum 10, which has a horizontal axis X—X (see FIGS. 2 and 5). A lining is supported by a portion of cylindrical body 10 and forms annular track 12 for a material to be crushed. Roller 16 is maintained in the interior of cylindrical body 10 in a fixed position and is arranged to roll on annular track 12 while being pressed thereagainst by springs or jacks (not shown) to crush the material between annular track 12 and roller 16. The clockwise direction of rotation of annular track 12 is indicated by arrows in FIGS. 1 and 4.

Figure 2:
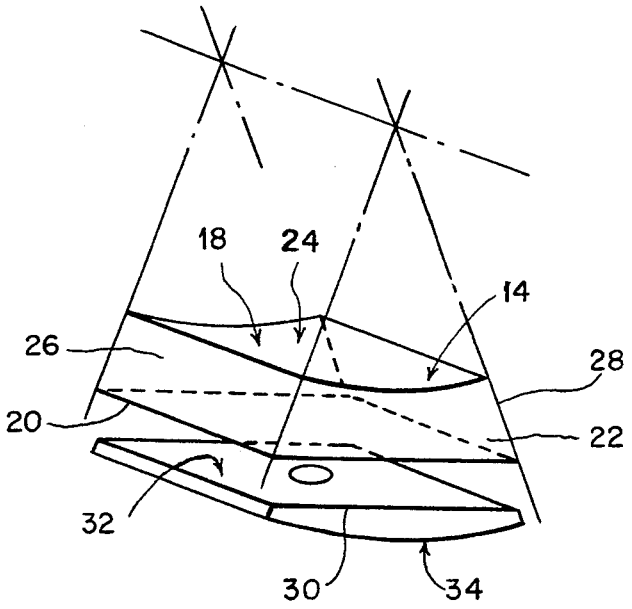
FIG. 2 is an exploded perspective view showing a wedge of the prismatic interior surface of the cylindrical body portion and a lining plate supported on the wedge.

As shown in the drawing and more particularly in FIG. 1, the supporting cylindrical body portion has a prismatic interior surface, and the lining forming annular track 12 consists of plates 14 of a hard metal, which are disposed side-by-side to form a cylindrical rolling surface about a horizontal axis. As best shown in FIG. 2, each lining plate 14 has a concave interior surface 18 shaped to form a rolling surface of the annular track and a flat exterior surface 20 resting on the prismatic interior surface of the supporting cylindrical body portion. It further has two side faces 22 and 24 extending perpendicularly to axis X—X of the annular track, a front face 26 and rear face 28, the front and rear faces extending in planes containing the annular track axis. The terms "front" and "rear", as used throughout the specification and claims, refer to the direction of rotation of the cylindrical body and annular track, front faces 26 passing under roller 16 before rear faces 28 during the operation of the crusher. This definition applies to such crushers in which the annular track is fixed and the roller is subjected to a rotary movement about the axis of the crusher.

As shown in FIG. 1, the prismatic interior surface of the supporting cylindrical body portion 10 is comprised of wedges 30 arranged on an interior wall of the body portion, and each wedge 30 has an exterior cylindrical surface 34 of the same radius as the interior body portion wall and a flat interior surface 32 whereon the flat exterior surface 20 of a respective plate 14 rests. The wedges are affixed to the interior cylindrical body portion wall, for example by welding. Wedges 30 form the prismatic interior surface whose directrix is a regular polygon, and flat exterior surface 20 of plates 14 has a size substantially equal to the size of supporting faces 32 of the prismatic interior surface, front and rear faces 26 and 28 extending in planes defined by axis X—X of the annular track and respective edges of the prismatic interior surface. The size of supporting faces 32 is a little bigger than that of flat exterior faces 20 to provide sufficient play between the plates to permit their assembly on the prismatic interior surface, which produces joints between adjacent plates 14, which may be filled with a synthetic resin, for example an epoxy resin, so that these joints are not filled with particles of the material to be crushed at the start of the crusher operation.

In the embodiment illustrated in FIG. 1, the prismatic interior surface has corners 35 distributed regularly over the periphery of the cylindrical body portion 10 and flat support faces 32 for the plates between the corners where the flat support faces intersect. Corners 35 are located in the planes defined by front faces 26 and rear faces 28 of plates 14.

Depending on the width of the annular track, it may be formed by one of several circular rows of lining plates. Also, each wedge may support a single plate or the adjacent plates of several rows.

Figure 3:
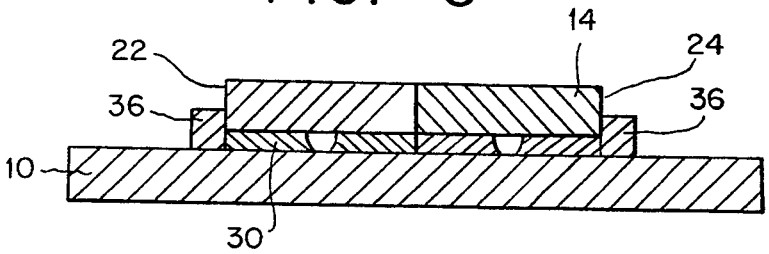
FIG. 3 is a section along line 3—3 of FIG. 1.

As shown in FIG. 3, two annular retaining rings 36 are affixed to the cylindrical body portion, for example by welding, and extend along front and rear faces 22, 24 of the plates for retaining plates 14 therebetween. In such an assembly, no other means, such as screws or bolts, needs to be used to hold the lining plates on the interior wall of the cylindrical body against displacement in a direction extending parallel to axis X—X. The plates are held in place like an arch, the prismatic interior surface defined by wedges 30, which support plates 14, preventing the circumferential displacement of the assembled plates with respect to the wedges.

If desired and instead of providing wedges affixed to the interior wall of the cylindrical body, the prismatic interior surface may be machined into the interior wall or into a ring affixed thereto.

Figure 4:
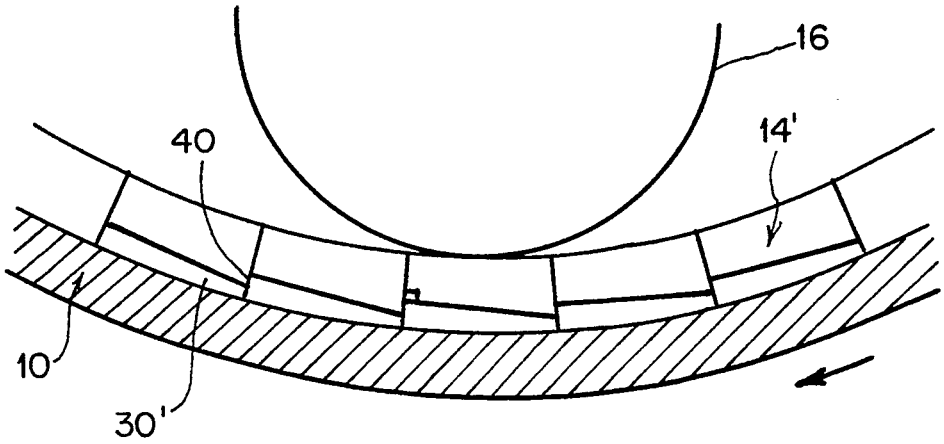
FIG. 4 is a view similar to that of FIG. 1 and illustrating another embodiment of this invention.
Figure 5:
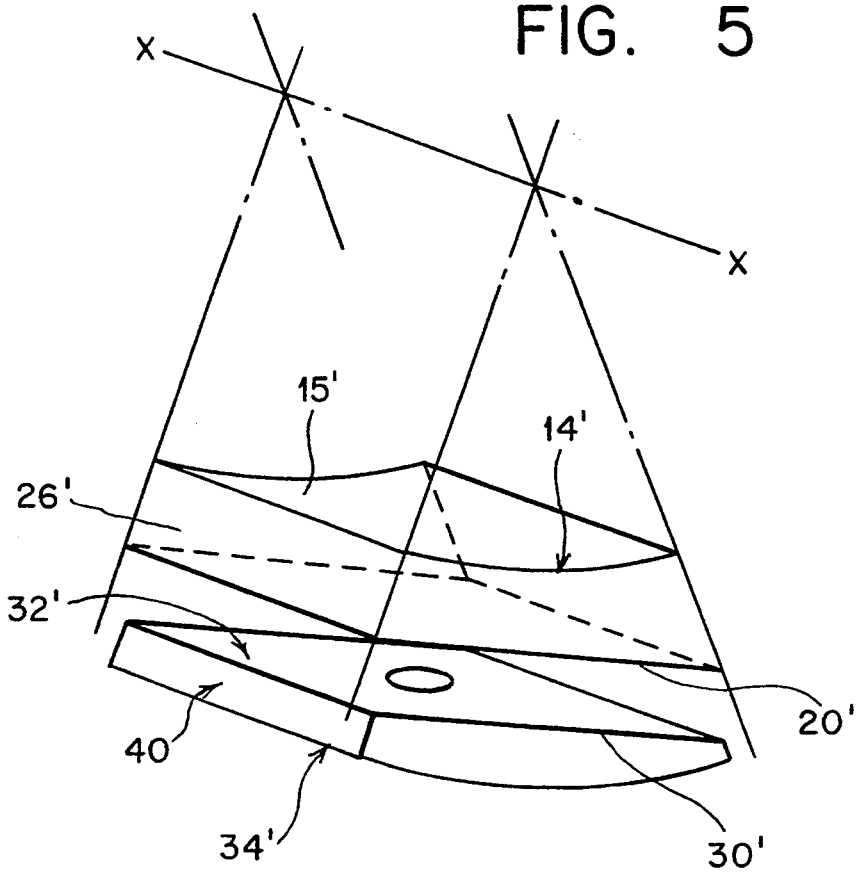
FIG. 5 is a view similar to that of FIG. 2 and illustrating the embodiment of FIG. 4.

In the embodiment shown in FIG. 4, the prismatic interior surface is comprised of wedges 30' arranged on an interior wall of the cylindrical body portion, the wedges having a thickness diminishing from front to rear so that adjacent wedges define corners. Flat interior surface 32' of the wedges, which supports lining plates 14', extends perpendicularly to front face 40 of wedges 30', which form the corners. Lining plates 14' have a thickness which increases from front face 26' to the rear face between the front and rear faces of the plates. The front and rear faces extend in planes defined by axis X—X of the annular track and respective faces of the prismatic interior surface forming the corners. Front face 26' of plates 14' extends perpendicularly to flat exterior surface 20' thereof and the front face of the wedges forming the corners extend perpendicularly to flat face 32' whereon plates 14' rest.

Due to this configuration of wedges 30' and lining plates 14', the component of the radial forces applied by roller 16, which is parallel to the surface supporting a lining plate, always extends in the same direction, from front to rear, when the generatrix along which these forces are applied is displaced from front to rear of the plate because of the rotation of the annular track. Therefore, the lining plates which protect the annular track against wear always remain in abutment with the corners formed by the front face 40 of wedges 30', which prevents an alternating displacement of the plates. Such a displacement would cause shocks and resultant deterioration of the plates.

Instead of being cylindrical, the rolling surface of annular track 12 could be toric or frusto-conical, or formed of several cylindrical surfaces of different diameters, and the shape of the interior surface of the lining plates would, of course, have a corresponding shape. Such modifications are encompassed by the term "cylindrical" used throughout the specification and claims. Also, the annular track may be fixed, instead of being rotated during operation of the crusher, and the roller may be rotated about the axis of the annular track. Furthermore, while a crusher having a horizontal axis has been illustrated, the axis may extend vertically.

What is claimed is:

1. A crusher comprising (a) a cylindrical body, (b) a lining supported by a portion of the cylindrical body and forming an annular track, (1) the entire supporting cylindrical body portion having a prismatic interior surface, and (c) at least one roller arranged to roll under pressure on the annular track, (1) the lining consisting only of plates having a concave interior surface shaped to form a rolling surface of the annular track and a flat exterior surface resting on the prismatic interior surface of the supporting cylindrical body portion.

2. The crusher of claim 1, wherein the prismatic interior surface of the supporting cylindrical body portion is comprised of wedges arranged on an interior wall of the body portion, the wedges having an exterior cylindrical surface of the same radius as the interior body portion wall and a flat interior surface whereon the flat exterior surface of respective ones of the plates rest.

3. The crusher of claim 1, wherein the prismatic interior surface is machined into an interior wall of the cylindrical body portion.

4. The crusher of claim 1, wherein the directrix of the prismatic interior surface is a regular polygon, and the flat exterior surface of the plates has a size substantially equal to the size of supporting faces of the prismatic interior surface, the plates having front and rear faces extending in planes defined by the axis of the annular track and respective edges of the prismatic interior surface.

5. The crusher of claim 1, wherein the prismatic interior surface has corners distributed regularly over the periphery of the cylindrical body portion and flat support faces for the plates between the corners where the support faces intersect, the plates having a thickness which increases from front to rear between front and rear faces of the plates, and the front and rear faces extending in planes defined by the axis of the annular track.

6. The crusher of claim 5, wherein the front face of the plates extends perpendicularly to the flat exterior surface thereof and the prismatic interior surface having a front face forming said corners and extending perpendicularly to the flat faces whereon the plates rest.

7. The crusher of claim 6, wherein the prismatic interior surface is comprised of wedges arranged on an interior wall of the cylindrical body portion, the wedges having a thickness diminishing from front to rear.

8. The crusher of claim 1, further comprising annular retaining rings affixed to the cylindrical body portion and extending along the sides of the plates for retaining the plates therebetween.

9. The crusher of claim 1, wherein adjacent ones of the plates define joints therebetween, further comprising a synthetic resin filling the joints.

10. A lining plate for an annular track of a crusher comprising a cylindrical body having an interior wall supporting the track and at least one roller arranged to roll on the track, the plate having a concave interior surface shaped to form a rolling surface of the annular track and a flat exterior surface adapted to rest on a flat face of the interior wall, the thickness of the plate increasing from a front face to a rear face.

11. The lining plate of claim 10, wherein the front face of the plate extends perpendicularly to the flat exterior surface.

* * * * *